United States Patent [19]

Kornmann

[11] 4,431,688

[45] Feb. 14, 1984

[54] PROCESS AND INSTALLATION FOR THE HIGH-VELOCITY DIP-COATING OF FILAMENT LIKE MATERIALS

[75] Inventor: Michel Kornmann, Geneva, Switzerland

[73] Assignee: Kokoku Steel-Wire Ltd., Tokyo, Japan

[21] Appl. No.: 313,982

[22] Filed: Oct. 22, 1981

[30] Foreign Application Priority Data

Mar. 10, 1981 [JP] Japan ..... 56-34762

[51] Int. Cl.[3] ..... B05D 1/18; B05D 3/04; C23C 1/00; C23C 1/12

[52] U.S. Cl. ..... 427/310; 427/313; 427/314; 427/319; 427/320; 427/321; 427/329; 427/331; 427/434.5; 427/434.7

[58] Field of Search ..... 427/310, 313, 314, 319, 427/320, 321, 329, 434.5, 434.7, 331

[56] References Cited

U.S. PATENT DOCUMENTS

| | | | |
|---|---|---|---|
| 1,454,224 | 5/1923 | Schmidt | 427/434.5 |
| 2,382,868 | 8/1945 | Fink | 427/434.7 |
| 2,497,119 | 2/1950 | Fink | 427/434.7 |
| 2,914,423 | 11/1959 | Knapp | 118/125 |
| 3,018,190 | 1/1962 | Knapp | 427/329 |
| 3,060,054 | 10/1962 | Russell et al. | 427/329 |
| 4,155,235 | 5/1979 | Pierson et al. | 427/329 |
| 4,169,426 | 10/1979 | Kornmann et al. | 427/434.7 |

*Primary Examiner*—Norman Morganstern
*Assistant Examiner*—Richard Bueker
*Attorney, Agent, or Firm*—Armstrong, Nikaido, Marmelstein & Kubovcik

[57] ABSTRACT

In a case where filament-like articles (e.g. wires) are dip-coated by upwardly passing the article into a bath of molten metal through the bottom and top vertical openings of a spout containing the molten metal, the article to be coated is wrapped, before it enters the bottom inlet opening in the spout, with a blanket of protective gas at a pressure sufficient to cause the gas to penetrate into the spout simultaneously with the article, to progressively and regularly circulate around the molten metal and to steadily emerge from the upper opening of the spout still effectively shielding the freshly coated article.

14 Claims, 3 Drawing Figures

PROCESS AND INSTALLATION FOR THE HIGH-VELOCITY DIP-COATING OF FILAMENT LIKE MATERIALS

The present invention relates to the high-velocity dip-coating (hot dipping) of filament like materials (wires or other filament-like objects) in a bath of molten metal. In this process, the wire is rapidly fed and immersed into the molten metal bath and withdrawn from it, whereby a thin layer of said metal of the bath will adhere thereto and quickly solidify by cooling, the contact time between the substrate (wire) and the molten melt being short enough for not detrimentally disturbing the intrinsic physical properties of said substrate (by annealing, for instance). Such processes are sometimes referred to as "freeze-coating".

Several conventional processes and devices are based on this technique. Thus, for example, British Pat. No. 982,051 describes a process for coating very thin silica fibers with aluminum, consisting in advancing the fiber downwardly through a vertical slit provided at the extremity of a vessel spout or nozzle, molten aluminum being continuously supplied to the lateral edges of the slit by the intermediary of the nozzle in such manner as to become deposited on the fiber traversing the melt. Fibers so coated, upon emerging from the bath, may be surrounded by an atmosphere of low oxidizing effect designed to avoid the formation of an oxide pellicle on the resulting coating. However, a major disadvantage of this procedure lies in the fact that the downward movement of the fiber causes an irregular and too abundant outflow of the aluminum from the nozzle and makes it difficult to control the quality and the uniformity of the obtained coating. Such a process, moreover, appears to be almost exclusively limited to the deposition of aluminum layers since the utilization of another material, with higher density and lower surface tension, would cause unavoidable leakage of the molten mass from the nozzle.

Another known process for the continuous coating of a steel strip with aluminum, described in French Pat. No. 1,584,626 resides in upwardly advancing, at a maximum velocity on the order of 10 meters per minute, the previously degreased and/or pickled steel strip through the slit of a heated supply nozzle of refractory material filled with molten aluminum, the speed of the strip being such that the residence time of the strip in the nozzle is between 0.03 and 1 second. However, this relatively long residence time only limits but does not completely avoid the formation of a fragile intermetallic layer at the steel/coating interface and causes also an annealing of the substrate. Such a process remains, furthermore, limited to the coating of strips of small thickness (maximum possible thickness on the order of 0.5 mm). Besides, the absence of a neutral atmosphere at the nozzle outlet creates problems regarding the uniformity of the coating on the strip.

There exist also a number of other processes and devices for coating strips or wires. However, the coating velocity obtained with all these processes or devices are limited, the maximum speed being in fact on the order of 60 meters/minute.

Recently, the present Applicant has disclosed (see U.S. Pat. No. 4,169,426) a freeze-coating apparatus comprising a vessel provided with a lateral nozzle below the bath as known per se from the aforementioned British Pat. No. 982,051, yet with the difference that the workpiece to be coated—i.e. a filiform element—moves vertically upwardly through the molten coating material in the nozzle by way of a tubular inlet in a lower wall portion and an annular outlet in an upper wall portion thereof. The inlet, advantageously formed by a tube adjustably seated in an aperture of the lower wall portion, has a diameter substantially equal to that of the filiform element to be coated so as to be traversed by the latter virtually without clearance. The coaxial outlet, on the other hand, has a diameter ranging between substantially two and three times that of the workpiece and thus also of the inlet and is formed by a substance which is substantially nonwettable by the coating material. In this apparatus, a protective gas is admitted into an enclosure surrounding the upper nozzle and extending upwardly therefrom. The effect of this gas is to prevent the possible oxidation of the coating when still hot and the formation of slag, ripples or other defects and to build sufficient back pressure to prevent accidental overflow of the molten metal. Optionally, a neutral gas or vacuum can also be provided at the nozzle inlet.

It has now been found by the present inventor that instead of introducing the inert gas into the spout outlet nozzle for surrounding and protecting the wire as it emerges from the molten metal, it is advantageous to already bring said inert gas into contact with the wire to be coated prior to the introduction of the latter into the molten metal. In such conditions, better coating quality is obtained.

Thus, the process of the present invention comprises contacting and surrounding the wire with an inert gas before it enters the molten metal bath through the nozzle inlet with a pressure sufficient for such gas to penetrate within the spout simultaneously with the wire, progressively circulate or creep along the inside walls thereof around the molten metal and finally emerge through the outlet still surrounding the coated wire. The operating parameters of the process must therefore be set up for having the above described conditions remain permanently valid and may be controlled by adjusting, according to the needs, the temperatures, the wire velocity and the overall gas pressure, all such parameters being naturally dependent on the apparatus construction features, the type of metal used for coating, the nature of the wire and any other factor which is normally controlled by men skilled in the art during operation. Thus, it has been found that if the protective gas relative pressure is too low near the inlet of the coating nozzle, the gas will not be caused to get around the molten metal toward the nozzle exhaust and will be absent in the space surrounding the wire in the outlet compartment, thus creating conditions in which the freshly coated wire may undergo oxidation damages for lack of adequate protection. In contrast, if the pressure of the protective gas is too much, the gas may squirt through the molten metal thus causing projections and irregular coatings. Further, if the pressure is much too high, the gas will flow around the wire in which case contact between the wire and the molten metal will be suppressed and there will be no coating. Ideal working parameters are those in which the protective gas pressure is kept between the above opposite extremes, under which conditions there will be a gentle and steady flow of gas within the coating nozzle going from the inlet to the outlet thereof and a regular and constant outflow gas around the coated wire.

The present process will now be illustrated by reference to an installation for dip-coating (plating) a wire with a molten metal, for instant liquid aluminum. It should be remembered that the installation described herein is only one embodiment among others which may also be used for carrying out the process of the invention.

The embodiment which is not limitative is described with reference to the annexed drawing in which FIG. 1 is a flow-diagram schematically showing the various steps involved in the dip-coating of a filament-like object, namely a steel-wire.

Figure 1:
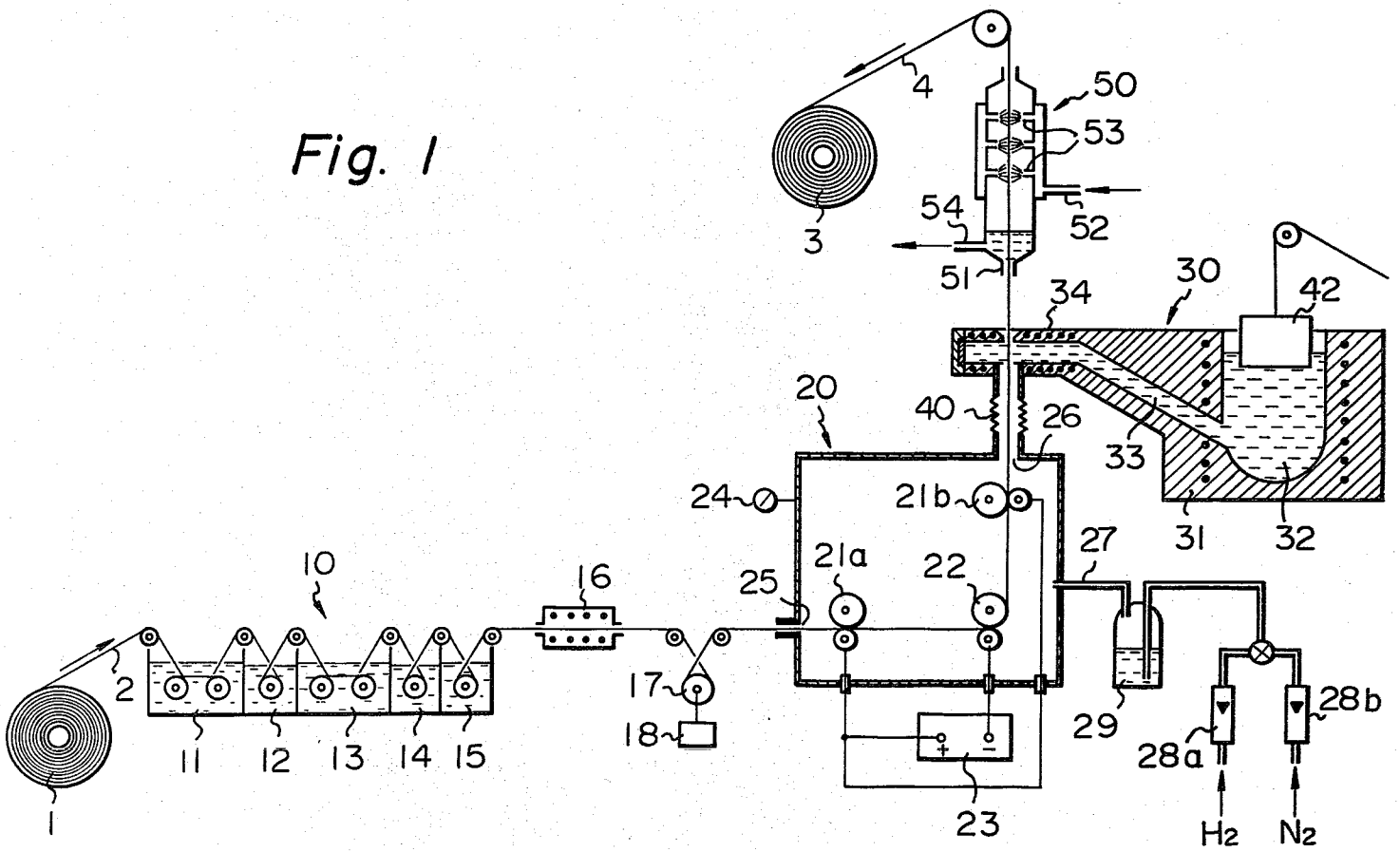

The main components of the present installation are, besides a take-off spool 1 for the wire 2 to be coated and a take-up spool 3 for the coated wire 4, a cleaning unit 10, a unit 20 for preheating the wire before the coating, the coating unit 30 itself and a cooling unit 50.

The cleaning unit 10 comprises a series of batches 11 to 15 containing liquids into which the wire is first driven by means of a set of pulleys shown on the drawing (but not numbered for the sake of clarity). The first bath 11 is for degreasing the wire by means of a suitable alkaline scouring medium or, otherwise, an organic solvent like petroleum or a chlorinated hydrocarbon (e.g. trichloroethylene). Then, the second bath 12 is for rinsing and can be pure water or, if an organic solvent was initially used, a hydrocompatible solvent such as alcohol, acetone or the like. In the third bath 13, the wire undergoes pickling or etching with a dilute acid such as HCl in possible admixture with organic acids such as formic or oxalic, inhibitors such as thiourea and wetting agents such as commercial surfactants. Then the wire is rinsed with pure water in batches 14 and 15 and it is dried in an over 16. After passing over a tension controlling member 17, the function of which is schematized by means of a weight 18 suspended to a pulley, the wire enters the preheating unit 20.

This preheating unit 20 is an air-tight enclosure that comprises three pinching rolls 21*a*, 21*b* and 22 which act as electric contacts for supplying power from a generator 23. Roll 22 is connected to the common negative (−) of this generator and the other rolls to the (+) terminal. Of course, the polarity is purely arbitrary here and the connections could be reversed with no inconvenience. Alternatively, the power could be AC if desired. What is important is that the voltage present between roll 22 and rolls 21*a* and 21*b* produces a heating current by the Joule effect along the wire in the section limited by the pinching rolls. The distance between the rolls can be varied at will such that the resistance can be adapted depending on the wire diameter, the heat to be developed (the temperature to be given to the wire) and the generator electrical parameters. Preferably, the generator 23 delivers from about 6 to 24 volts with a capacity of several hundreds of amps for heating the wire very quickly (the wire may circulate at high speed e.g. 10–1000 m/min). The temperature at which the wire is heated is also very variable and depends on parameters such as wire material, dimensions and cleanliness, molten metal nature, thickness of the deposit, etc. Generally, a compromise must be found between a lower temperature level for ensuring adherent, efficient and regular coating and a higher level which is set up not to affect the inherent physical properties of the wire (hardness, tensile, etc.) which might be altered by too much heat. The preheating enclosure 20 also comprises a pressure gage 24, a wire inlet 25, an outlet 26 and a gas inlet 27. The gas inlet 27 is for admitting a protective gas (e.g. $N_2$ or a rare gas) within the enclosure usually with some reductive component such as hydrogen, methane, carbon monoxide or any good reducing gas. The pressure of this gas can be monitored by gage 24. The reductive component of the gas is to constantly maintain a reductive capacity toward oxygen within the enclosure and the wire surroundings before and after coating, this being for preventing possible oxidative fouling before coating or damage to the coating itself. On the drawing, supplies of $H_2$ and $N_2$ have been represented by arrows (which can mean compressed gas cylinders not shown) and are monitored by rotameters 28*a* and 28*b*. Then the mixture of gases (usually from about 10–50% $H_2/N_2$ v/v) enters the preheating enclosure after being loaded with flux vapors by passing through a washing bubbling bottle 29 that contains a volatile flux in liquid or solution form. Of course, the bottle could be replaced by other containers and impregnation of the gas could be achieved by passing through a porous substrate (felt or other) soaked with the flux. Indeed, the inventor has found that providing the flux as a vapor (or particle gas suspension) mixed with the protective gas is an advantage because the action of such flux is then more evenly distributed on the wire surface than if that flux was provided (as it usually is) as a liquid film around the wire after passing in the cleaning unit (a flux film loosely deposited on a wire is much likely to be disturbed by the means for driving and deflecting the wire like pulleys, reels, etc.). Also, having irregularly distributed flux is detrimental for good electrical contacts in the pinching rolls. Furthermore, the method for applying the flux in the present invention uses less flux per unit area of the wire, is thus more economical and causes much less slag build up in the molten metal during coating due to flux decomposition. The fluxes that can be used in the washing bottle are any volatile flux known in practice for fluxing substrates before soldering or coating with liquid metals, namely for instance, alcoholic or aqueous HCl, HF or organic (e.g. methanolic) solutions of salts such as $NH_4Cl$, ammonium fluoborate, aluminum trichloride; or liquid compounds relatively volatile which can act as fluxes, e.g. neat $BF_3$, $BCl_3$, $SiCl_4$, $SnCl_4$, $SbCl_3$, etc.; or solutions of organic compounds such as amine hydrochlorides (e.g. hydrazine hydrochloride), chlorinated hydrocarbons (chloracetic acid, chloroaceton, chloramine-T, $CCl_4$, etc.). Such solutions need not be very concentrated, concentration between about 1 and 10% by weight of the active compound being sufficient with a bubbling rate is rather more dependent on the amount of pressure of protective gas to be maintained in the preheating and plating area (to be now described), since the amount of gas to be used for maintaining such pressure and preventing the accidental penetration of the outside atmosphere is essentially dependent on the leaks (normal or accidental) in such areas. Normal leaks are the leaks associated with the openings for the wire (inlets and outlets) that can be more or less wide or narrow depending on the construction and the use of seals whenever possible (as will be seen hereafter). Actually, normal leaks should not be removed completely because some extent of leaking is advantageous in order to continuously renew the gas within the enclosure. Such renewing is required for continuously eliminate moisture and the gaseous impurities which form in the preheating enclosure due to the action of the reducing gas on the wire during the preheating stage (impurities arising from the cleaning of the wire by fluxing, reduction, etc.). If such impurities were not removed by renewing continuously the gas in the enclosure, they would progressively pollute the molten metal because of the protective gas continuously flowing into the coating nozzle and contacting the molten metal therein. However, the inlet 25 is normally equipped with a seal to prevent exaggerated gas leakage. The construction of outlet 26 will be described hereinafter as being the linking member between the preheating and coating areas of the present installation.

Figure 2:
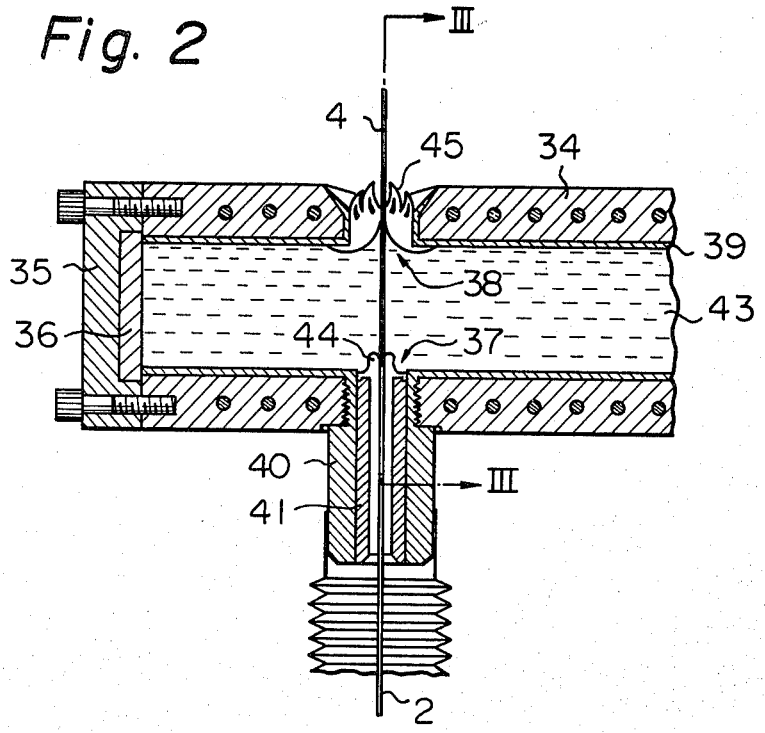
FIG. 2 is an enlarged sectional view of the plating nozzle of the installation of FIG. 1.
Figure 3:
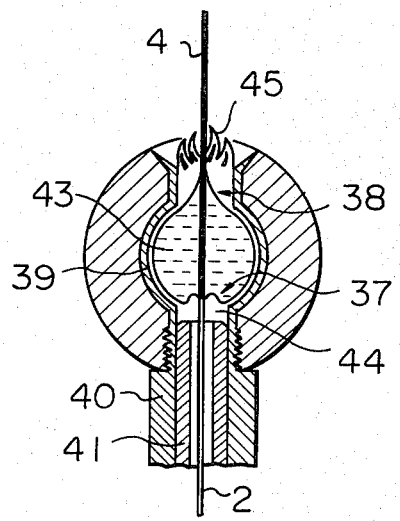
FIG. 3 is another enlarged section of the same nozzle along the lines III—III of FIG. 2.

The coating unit 30 comprises a furnace 31 provided with a crucible 32 for holding the molten metal to be coated on the wire. The crucible is provided with a side channel 33 for enabling the molten metal to reach a spout or coating nozzle 34. The spout (nozzle) 34 can also be heated, for instance by a resistance coil as shown on the drawing, in order to keep a good control of the temperature of the molten metal right in the dip-plating area. Naturally, a HF heating means would also be suitable. The construction of the nozzle 34 is better understood with reference to FIGS. 2 and 3. This nozzle actually consists of a cylindrically shaped side member (made of metal such as inconel) closed by a plug 35 and an asbestos seal 36. It is provided with a lower aperture 37 and an upper aperture 38 which are vertically aligned and is internally lined with a layer 39 of refractory material, e.g. $ZrO_2$. This refractory material is also non-wettable by the molten metal. If this were not so and that the molten metal would stick to the layer 39, it would be difficult for the protective gas to smoothly pass between the molten metal and said layer 39. The lower aperture 37 is fitted with a tubular connector 40 internally lined with a refractory sheath 41 which extends slightly below the aperture opening 37 and is made of a material not wetted by the molten metal, for instance alumina. The lower part of connector 40 is actually the linking member between the outlet 26 of the preheating unit and the coating unit. As can be seen on the drawing the walls of the connector have partially a bellow configuration. Such configuration is extendable (because of the elasticity of the material of the connector) and will allow for possible distortions of the equipment during operation (deformations may be caused by heat or mechanical vibrations). The connector 40 can be made of a metal resistant to heat, e.g. inconel. The crucible 32 is provided with a piston 42 which can be lowered or raised at will in the crucible opening and which applies pressure on the molten metal 43 therein, thus causing the liquid metal to more or less penetrate the coating spout (coating nozzle) depending on the height the piston 42 is set up. Acting on the piston therefore permits controlling the level of the molten metal in the coating spout, this effect being in combination with the pressure of the protective gas around the wire in the connector 40 and within the coating nozzle itself. Indeed, as can be better seen on FIG. 3, the protective gas is driven from the preheating area onto the coating area through connector 40 at a pressure sufficient to cause it to circulate around the molten metal (that is, between the walls 39 of the spout and the mass of metal 43). In doing so, the gas causes the formation of a meniscus-like flow configuration 44 at the inlet 37 and a regular exhaust gaseous sheath 45 around the wire. Usually, this gaseous sheath burns with a regular constant colorless flame when the protective gas contains a sufficient proportion of reducing component, e.g. $H_2$. This is a sign that the gas pressure conditions, as combined with the molten metal height set up by piston 42, are correct for having a good coating. Otherwise, if the gas pressure is too low, the flame will be cut off and air may enter the spout or if the pressure is too high, there will be gas bursts and spurts with irregular coating sections on the moving wire. Of course, if the pressure is too low, there is also a risk that the molten metal will fall down into the preheating enclosure through the openings 37 and 26 which is highly undesirable. Incidentally, it is worth mentioning that, in view of the pressure exerted by the protective gas at the inlet 37 the size of this inlet (diameter) is not particularly critical (as it was the case for the spout of U.S. Pat. No. 4,169,426), since even if there is relatively much room between the wire and the inlet walls, the molten metal is prevented from leaking therethrough right because of the existence of said counter-pressure from the protective gas. The present installation still comprises the cooling unit 50 in which the coated wire penetrates through a sealed opening 51. The cooling unit is composed of a hollow cylinder provided with a water-in line 52 for feeding water to spraying means 53. Such means cause the water to be sprayed on the hot wire to cool it rapidly to room temperature. Then, the water collects itself in the bottom of the unit and is evacuated through a drain 54 while the wire comes out on top of the cooling unit and is stored on spool 3.

The operation of the disclosed installation is self-evident from the above description. The wire is constantly pulled out by the take-up spool 3 (driven by a motor not shown) and is first fed, from the take off spool 1, to the cleaning unit whereby it gets degreased, pickled, rinsed and dried. Then it is electrically preheated to the correct temperature in the unit 20 wherein it gets surrounded by the protective gas and some flux in gaseous or suspended from coming from the gas inlet 27. The wire then passes through the outlet 26, the connecting member 40, the spout inlet 37 and the mass 43 of molten metal where it gets coated. Then it emerges through outlet 38 together with the accompanying gas the flow of which passes around the molten metal and back again to the wire on top of the liquid meniscus defined by outlet 38. Then the coated wire is cooled in the cooling unit 50 and is finally stored on the take-up spool 3.

The types of applications the present process and installation are suited to are the same as that described in U.S. Pat. No. 4,169,426. For instance, a steel wire like that described in Example 2 of the said patent can be coated with aluminum at a speed of 200 m/min using the following operating parameters: degreasing in alkaline degreaser; etching in HCl; preheating temperature: 400° C.; generator voltage: 30 V; current: 70 A; protective gas $H_2/N_2$: 20/80; preheating length: 2 m; pressure 2 mb; flux compound: HCl; flow of cooling water: 30 l/min; flow of gas: 600 l/h.

Other applications of other molten metals to other substrates (metal or non metals) can also be adapted from in the art in conformity with the present invention.

I claim:

1. A process for high-velocity dip-coating of filament-like articles by upwardly passing the article through bottom and top vertical openings of a spout containing molten metal, so as to provide a continuous molten-metal coating on the article; which comprises surrounding the article with a protective gas, wherein the spout has spout walls made of a material which is non-wettable by the molten metal, so that the protective gas penetrates into the molten metal in the bottom opening of the spout simultaneously with the article; then substantially all the protective gas progressively and regularly circulates between the spout walls and the molten metal away from the article, and thereafter emerges from the top opening of the spout surrounding and effectively shielding the molten-metal coated article.

2. The process of claim 1, in which the protective gas is a mixture of an inert gas and a reductive component.

3. The process of claim 2, wherein the inert gas is selected from the group consisting of nitrogen and a rare gas.

4. The process of claim 2, wherein the reductive component is selected from the group consisting of $H_2$, CO, $CH_4$ and an organic compound vapor.

5. The process of claim 2, in which the protective gas is nitrogen with from 10 to 50% by volume of hydrogen.

6. The process of claim 1, in which the protective gas also contains a flux dispersed within the gas in the form of a vapor or a mist.

7. The process of claim 6, in which the flux is selected from the group consisting of volatile acid, volatile salt and organic halide.

8. The process of claim 6, in which the flux is added to the gas by passing the latter through a bottle or another container enclosing the flux in pure of solution form.

9. The process of claim 7, wherein the volatile acid is HCl.

10. The process of claim 7, wherein the volatile salt is selected from the group consisting of $BF_3$, $SiCl_4$ and $SbCl_3$.

11. The process of claim 7, wherein the organic halide is selected from the group consisting of $CCl_4$, alkyl halides and chloramines.

12. The process of claim 1, in which the pressure of the gas is adjusted for preventing the molten metal to leak through the bottom opening of the spout and to prevent the formation of gas bubbles or bursts within the molten metal.

13. The process of claim 1, in which the article is electrically preheated before entering the spout containing molten metal.

14. The process of claim 13, in which the protective gas is introduced into the article preheating enclosure whereby blanketing by the gas becomes effective during the preheating stage.

* * * * *